US012310499B2

(12) United States Patent
Bright

(10) Patent No.: US 12,310,499 B2
(45) Date of Patent: May 27, 2025

(54) SHELF ASSEMBLY

(71) Applicant: Steve Bright, Wentworth, MO (US)

(72) Inventor: Steve Bright, Wentworth, MO (US)

( * ) Notice: Subject to any disclaimer, the term of this patent is extended or adjusted under 35 U.S.C. 154(b) by 0 days.

(21) Appl. No.: 18/221,910

(22) Filed: Jul. 14, 2023

(65) Prior Publication Data

US 2025/0017374 A1 Jan. 16, 2025

(51) Int. Cl.

| | |
|---|---|
| ***A47B 96/06*** | (2006.01) |
| ***A47F 5/08*** | (2006.01) |
| *A47B 57/48* | (2006.01) |

(52) U.S. Cl.

CPC ..... *A47B 96/063* (2013.01); *A47B 96/06* (2013.01); *A47F 5/08* (2013.01); *A47B 57/482* (2013.01); *A47B 96/068* (2013.01)

(58) Field of Classification Search

CPC ..... A47B 96/063; A47B 47/00; A47B 96/06; A47B 96/024; A47B 57/06; A47B 47/0025; A47B 47/021; A47B 47/024; A47B 57/20; A47B 57/26; A47B 57/30; A47B 57/48; A47B 57/482; A47B 57/54; A47B 96/068; A47F 5/08

USPC ..... 211/90.01, 90.02, 90.04, 135; 248/235, 248/243, 250

See application file for complete search history.

(56) References Cited

U.S. PATENT DOCUMENTS

| | | | | | |
|---|---|---|---|---|---|
| 325,696 | A * | 9/1885 | Post | A47B 47/00 | 5/299 |
| 753,678 | A * | 3/1904 | Dannenberg | A47B 7/02 | 108/190 |
| 1,059,464 | A * | 4/1913 | Hine | A47B 57/265 | 211/187 |
| 1,284,235 | A * | 11/1918 | Carlin | F16M 13/00 | 211/90.03 |
| 1,324,537 | A * | 12/1919 | Belcher | A47B 57/42 | 211/187 |
| 1,354,270 | A * | 9/1920 | Wood | A47B 96/061 | 180/68.5 |
| 1,764,131 | A * | 6/1930 | Walter | A47B 96/025 | 312/351 |
| 1,894,310 | A * | 1/1933 | Gueth | A47H 27/00 | 312/246 |
| 1,990,046 | A * | 2/1935 | Mayrose | A47B 47/04 | 292/218 |
| 2,081,763 | A * | 5/1937 | Peterson | A47B 61/00 | 108/30 |
| 2,157,309 | A * | 5/1939 | Swedman | A47B 57/50 | 248/222.52 |
| 2,315,595 | A * | 4/1943 | Chappory | A47F 5/13 | 211/186 |
| D165,118 | S * | 11/1951 | Strinning | 211/90.04 | |
| 2,951,594 | A * | 9/1960 | Strinning | A47B 57/06 | 108/106 |
| 3,100,460 | A * | 8/1963 | McElroy | A47B 57/16 | 108/109 |
| 3,136,270 | A * | 6/1964 | Von Arb | A47B 57/16 | 108/8 |

(Continued)

*Primary Examiner* — Devin K Barnett
(74) *Attorney, Agent, or Firm* — Joseph E. Maenner; Maenner & Associates, LLC

(57) ABSTRACT

A shelf assembly includes a left hand bracket and a right hand bracket, each with an upper shelf support and a lower shelf support. An upper shelf fits onto the upper shelf support and a lower shelf fits onto the lower shelf support.

9 Claims, 11 Drawing Sheets

(56) References Cited

U.S. PATENT DOCUMENTS 3,471,112 A * 10/1969 MacDonald ..... A47B 96/063 248/250
3,565,020 A * 2/1971 Schier ..... A47B 96/028 211/186
3,570,679 A * 3/1971 Edson ..... A47F 7/163 108/1
D230,797 S * 3/1974 Slaboden ..... D6/570
3,836,009 A * 9/1974 Horowitz ..... A47F 5/08 211/90.04
3,868,986 A * 3/1975 Olsen ..... B22C 7/023 108/107
3,986,616 A * 10/1976 Gray ..... A47B 57/18 108/107
4,052,816 A * 10/1977 Perez ..... A47H 27/00 211/88.03
4,076,203 A * 2/1978 McDonnell ..... A47B 57/10 211/187
4,183,488 A * 1/1980 Shepard ..... A47B 87/0246 108/190
4,231,300 A * 11/1980 Shepard ..... A47B 96/06 248/245
4,233,912 A * 11/1980 Ferdinand ..... A47B 57/10 108/109
4,666,117 A * 5/1987 Taft ..... A47B 96/063 211/187
4,732,358 A * 3/1988 Hughes ..... A47B 96/068 211/90.01
4,819,901 A * 4/1989 McDonald ..... A47B 57/52 248/250
D301,000 S * 5/1989 Christiansen ..... D6/570
5,026,015 A * 6/1991 Patrick ..... A47B 96/06 211/186
5,201,120 A * 4/1993 Patrick ..... A47B 96/06 211/186
5,253,837 A * 10/1993 Loux ..... A47G 25/0692 211/90.01
5,257,701 A * 11/1993 Edelson ..... A47B 3/10 482/148
5,393,135 A * 2/1995 Tisbo ..... A47B 81/068 312/319.1
5,957,060 A * 9/1999 Rosenband ..... A47B 57/22 211/187
D423,840 S * 5/2000 Carville ..... D6/705.1
6,123,033 A * 9/2000 Polley ..... A47B 46/005 211/186
6,758,352 B2 * 7/2004 Gervasi ..... A47F 5/0018 211/187
6,796,248 B1 * 9/2004 Dressendorfer ..... A47B 57/10 108/106
D509,393 S * 9/2005 Winig ..... D6/574
7,275,648 B2 * 10/2007 Segovia, Jr. ..... A47B 57/10 211/208
7,686,173 B2 * 3/2010 Robinson ..... A47B 57/30 211/187
9,370,242 B2 * 6/2016 Guizzardi ..... A47B 87/0223
10,159,339 B1 * 12/2018 Powell ..... A47B 57/485
10,905,235 B2 * 2/2021 Chiao ..... A47B 61/00
11,497,312 B2 * 11/2022 Hu ..... A47B 47/0058
2002/0166934 A1 * 11/2002 Marsh ..... A47B 96/06 248/250
2003/0196976 A1 * 10/2003 Gervasi ..... A47F 5/0018 211/187
2004/0104324 A1 * 6/2004 Oberhaus ..... A47B 96/028 248/250
2006/0118503 A1 * 6/2006 Patton ..... A47B 96/063 211/187
2006/0145037 A1 * 7/2006 Sloan ..... A47B 47/00 248/235
2006/0175493 A1 * 8/2006 Norman ..... E06B 7/28 248/235
2008/0011920 A1 * 1/2008 Sloan ..... A47B 43/003 248/235
2008/0047914 A1 * 2/2008 Young ..... A47B 96/02 248/235
2010/0155353 A1 * 6/2010 McAllister ..... A47B 96/028 211/153
2013/0062293 A1 * 3/2013 Beaty ..... A47F 5/11 211/59.2
2013/0307285 A1 * 11/2013 Richter ..... A47B 47/025 296/24.44
2014/0124466 A1 * 5/2014 Richmond ..... A47G 1/22 211/90.01
2015/0053635 A1 * 2/2015 Ahart ..... A47B 96/06 211/206
2016/0000239 A1 * 1/2016 Denby ..... A47F 7/30 211/28
2016/0235195 A1 * 8/2016 Ahart ..... A47B 96/024

* cited by examiner

SHELF ASSEMBLY

BACKGROUND OF THE INVENTION

Field of the Invention

The invention relates to a shelf assembly that uses minimal different parts and can be easily and quickly assembled.

Description of the Related Art

Do-it-yourself shelf assemblies can be confusing to build by inexperienced people, resulting in frustration and poor assembly, which can lead to the assembly collapsing when in use. Additionally, to be competitive with other shelf assemblies on the market, a commonality of parts and small packaging size can reduce the ultimate cost to the consumer.

It would be beneficial to provide a shelf assembly that uses minimal different parts and can be easily and quickly assembled.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, a shelf assembly comprises a left hand bracket and a right hand bracket, wherein each of the left hand bracket and the right hand bracket comprises a wall portion, a shelf support portion extending orthogonally from the wall portion, and an upper shelf support assembly. The upper shelf support assembly comprises an upper shelf support extending orthogonally from the shelf support portion, a first upper prong extending outwardly from the shelf support portion above the upper shelf support, and a second upper prong extending outwardly from the shelf support portion below the upper shelf support. Similarly, a lower shelf support assembly comprises a lower shelf support extending orthogonally from the shelf support portion, a first lower prong extending outwardly from the shelf support portion above the lower shelf support, and a second lower prong extending outwardly from the shelf support portion below the lower shelf support. An upper shelf has a left upper shelf tab extending from the upper shelf and a right upper shelf tab extending from the upper shelf, distal from the left upper shelf tab. A lower shelf has a left lower shelf tab extending from the lower shelf and a right lower shelf tab extending from the lower shelf, distal from the left lower shelf tab.

In an alternative embodiment, a shelf assembly comprises a left hand bracket and a right hand bracket. Each of the left hand bracket and the right hand bracket comprises an upper shelf support extending toward the other of the left hand bracket and the right hand bracket and a lower shelf support extending toward the other of the left hand bracket and the right hand bracket. An upper shelf has an upper shelf tab configured to rest on the upper shelf support and a lower shelf has a lower shelf tab configured to rest on the lower shelf support.

In another alternative embodiment, a shelf assembly comprises a left hand bracket and a right hand bracket. The left hand bracket and the right hand bracket are mirror images of each other. Each of the left hand bracket and the right hand bracket comprises an upper shelf support, an upper prong extending above the upper shelf support, a lower shelf support and a lower prong above the lower shelf support. An upper shelf has a left upper shelf tab extending from the upper shelf and a right upper shelf tab extending from the upper shelf, distal from the left upper shelf tab. The left and right upper shelf tabs are each configured to engage the respective upper shelf support and upper prong. A lower shelf has a left lower shelf tab extending from the lower shelf and a right lower shelf tab extending from the lower shelf, distal from the left lower shelf tab. The left and right lower shelf tabs are configured to engage the respective lower shelf support and lower prong.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
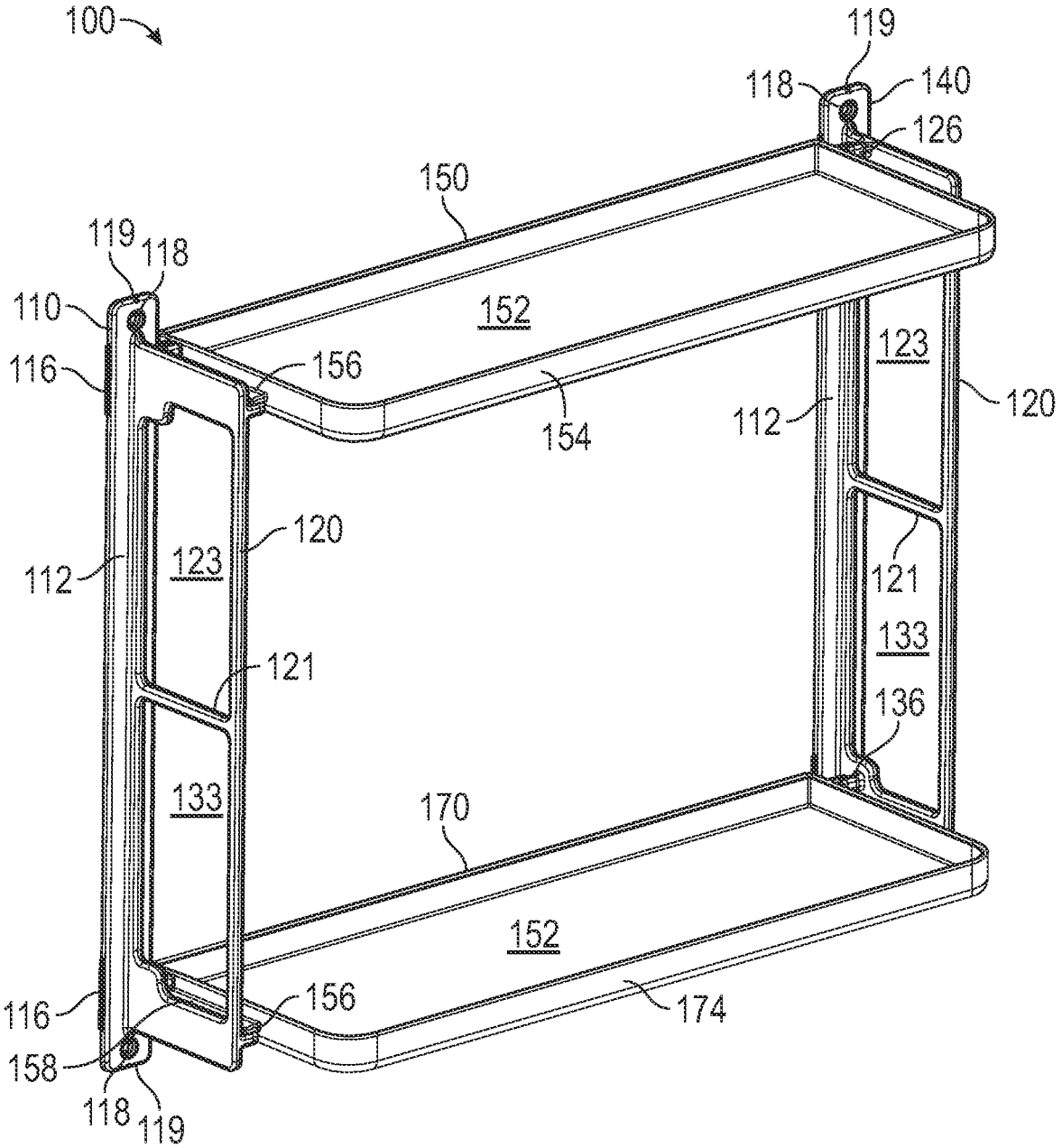
FIG. 1 is a perspective view of a shelf assembly according to an exemplary embodiment of the present invention.
Figure 2:
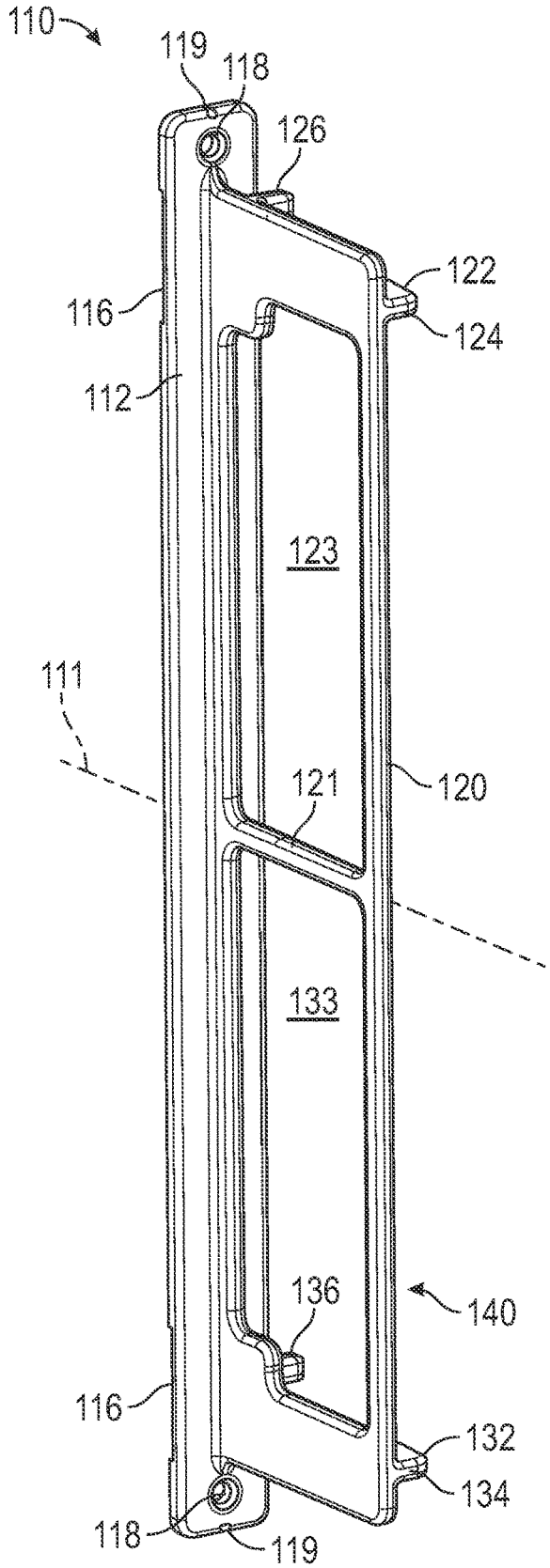
FIG. 2 is a front perspective view of a wall bracket used with the assembly of FIG. 1.
Figure 3:
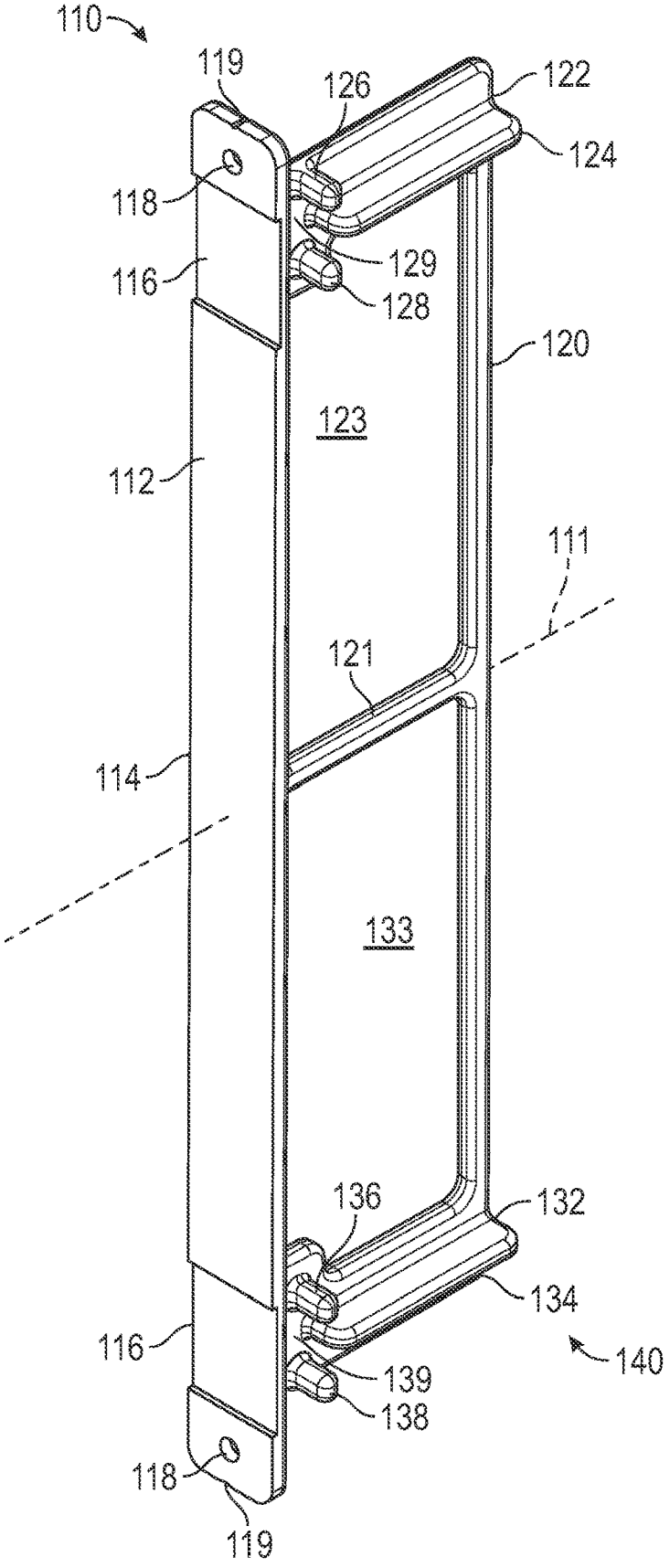
FIG. 3 is a rear perspective view of a wall bracket used with the assembly of FIG. 1.
Figure 4:
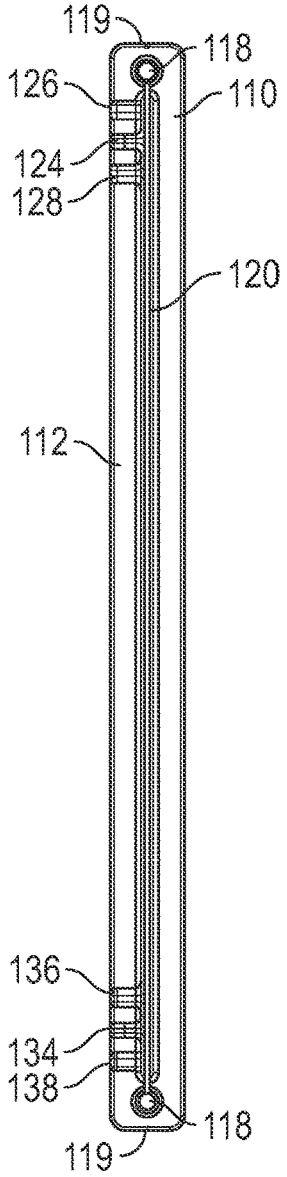
FIG. 4 is a front elevational view of the bracket of FIG. 2.
Figure 5:
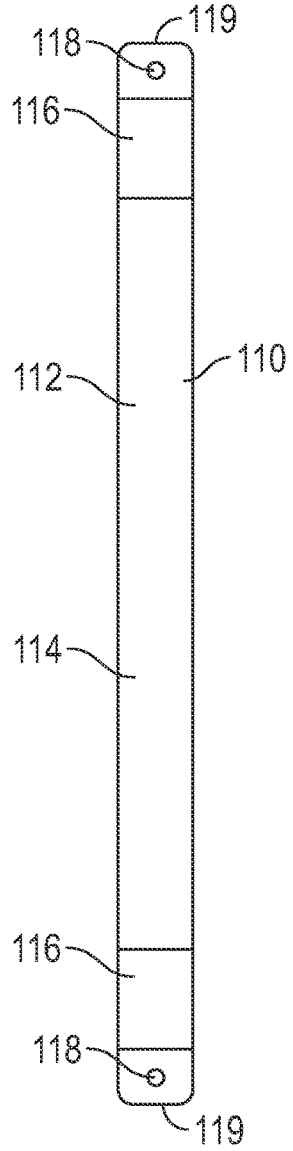
FIG. 5 is a rear elevational view of the bracket of FIG. 2.
Figure 6:
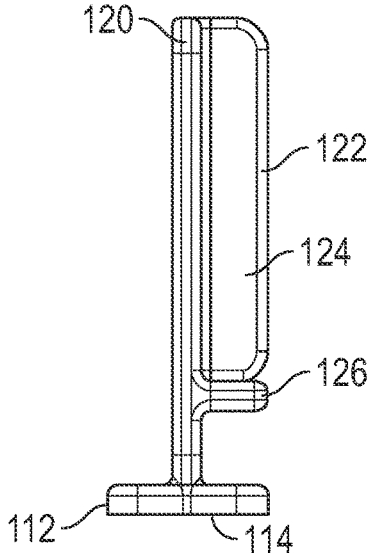
FIG. 6 is a top plan view of the bracket of FIG. 2, with the bottom plan view being a mirror image thereof.
Figure 7:
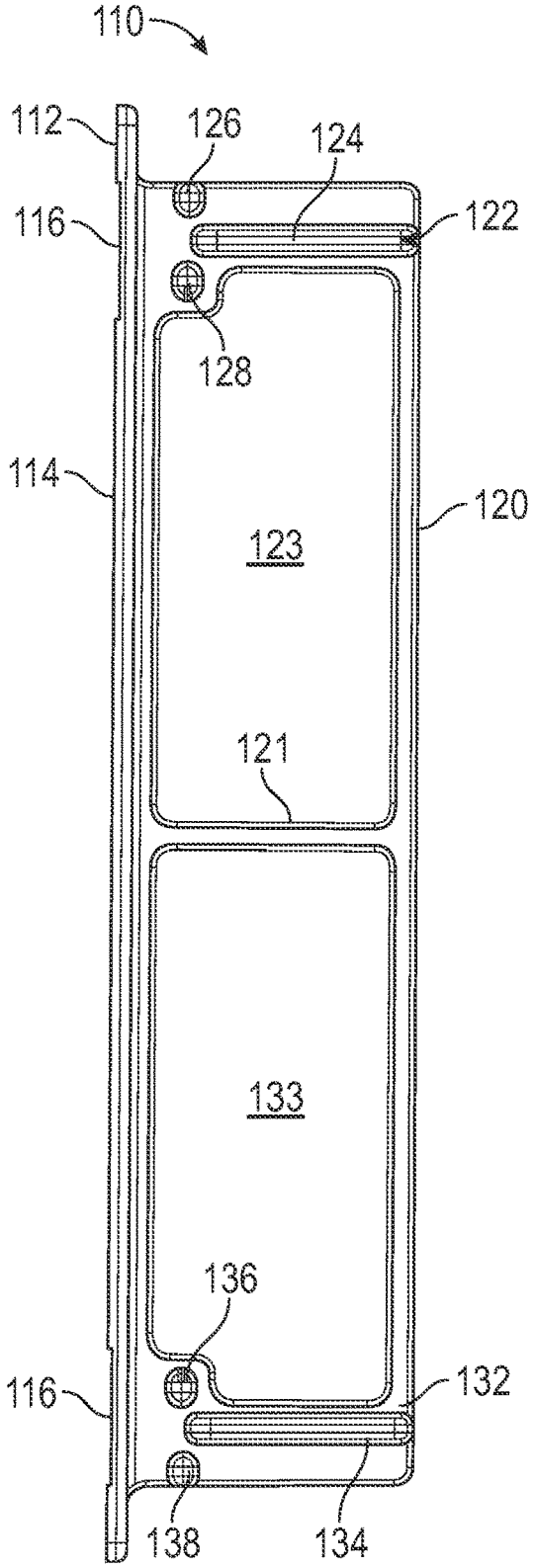
FIG. 7 is a left elevational view of the bracket of FIG. 2.
Figure 8:
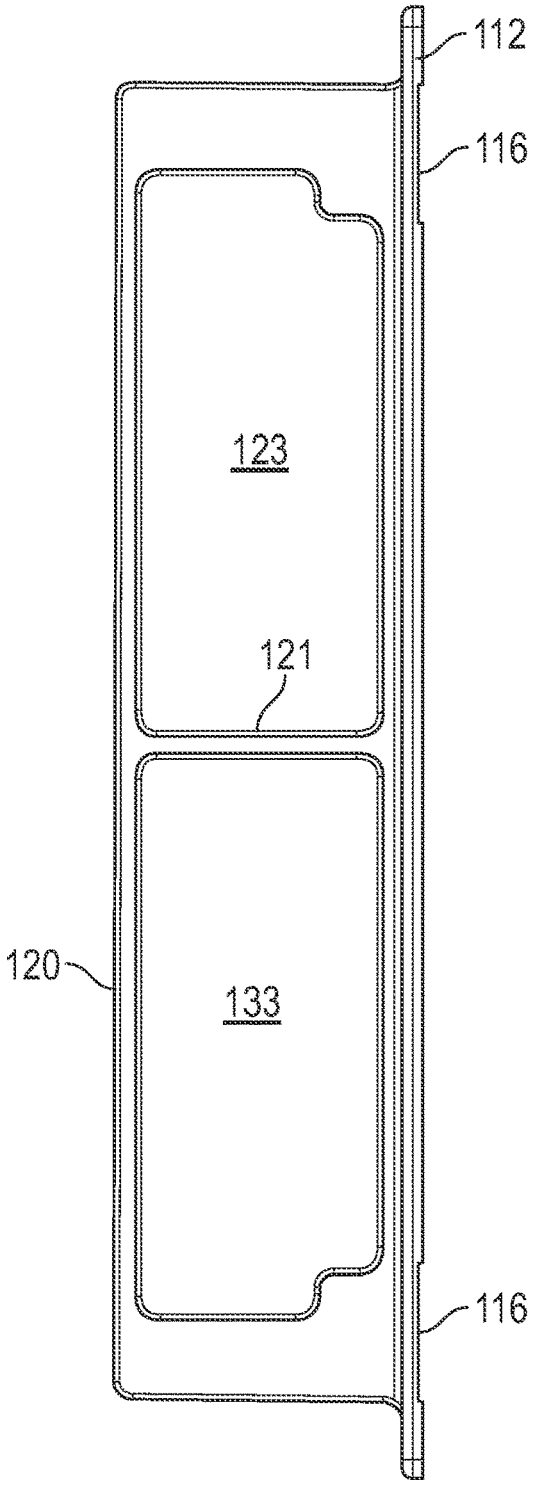
FIG. 8 is a right elevational view of the bracket of FIG. 2.
Figure 9:
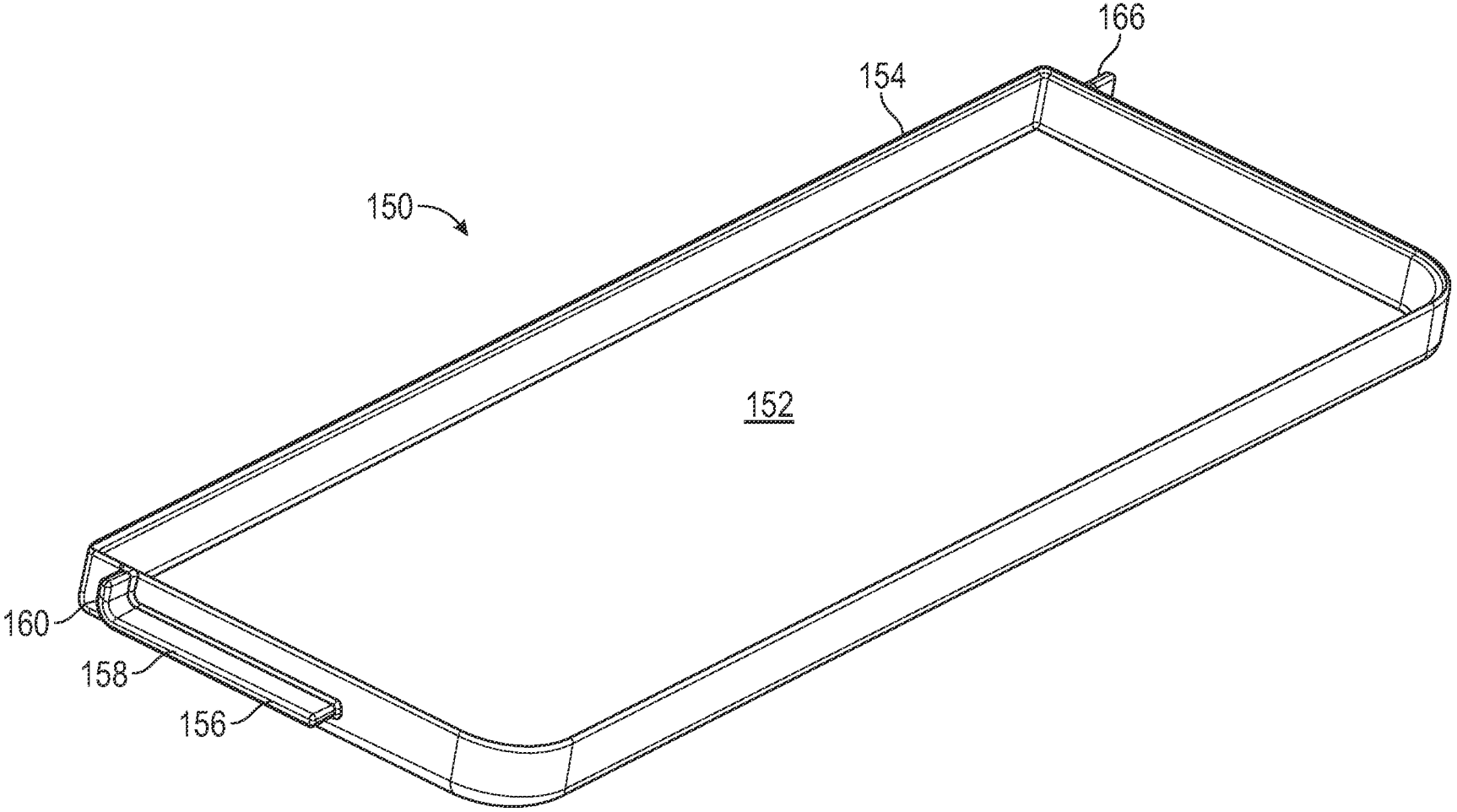
FIG. 9 is a perspective view of a shelf used with the assembly of FIG. 1.
Figure 10:
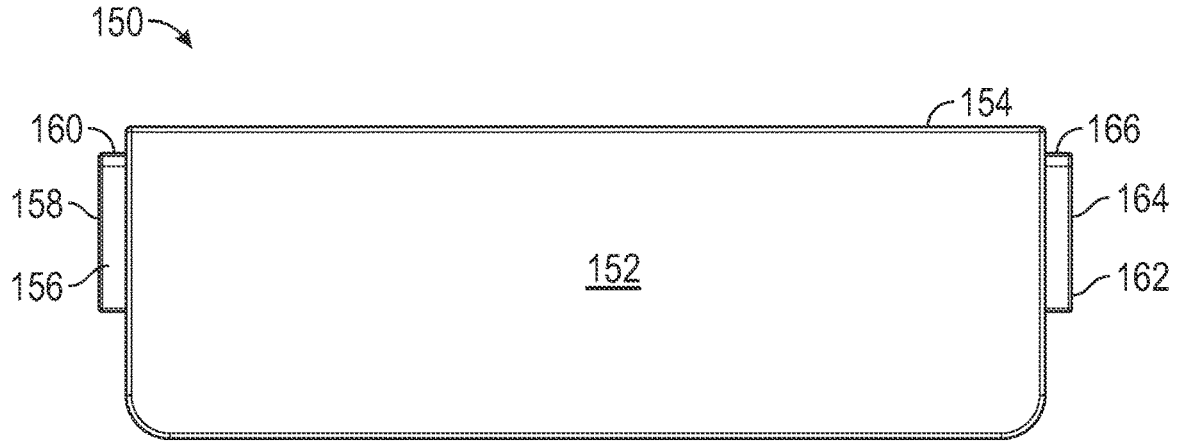
FIG. 10 is a top plan view of the shelf of FIG. 9.
Figure 11:
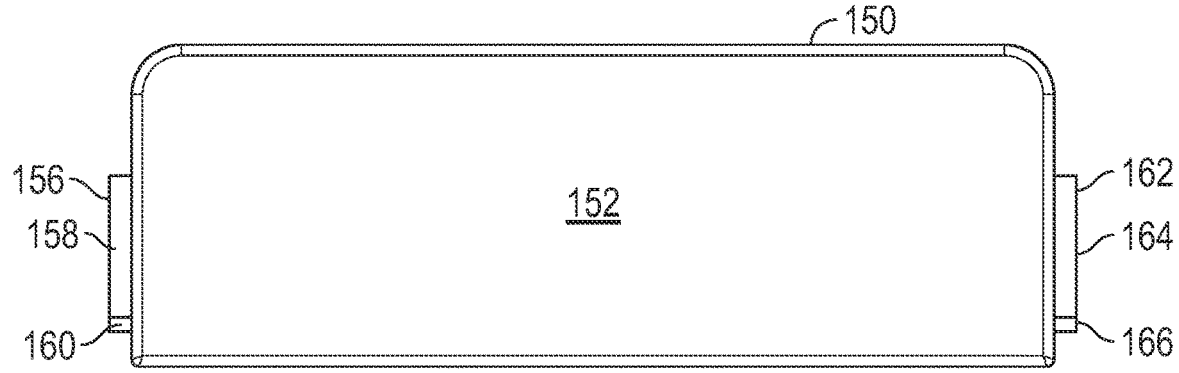
FIG. 11 is a bottom plan view of the shelf of FIG. 9.
Figure 12:
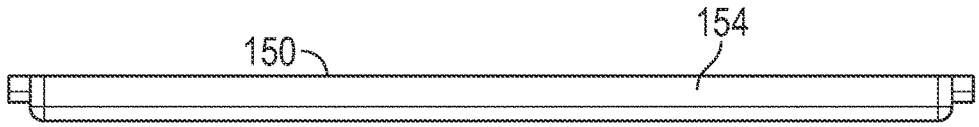
FIG. 12 is front elevational view of the shelf of FIG. 9.
Figure 13:
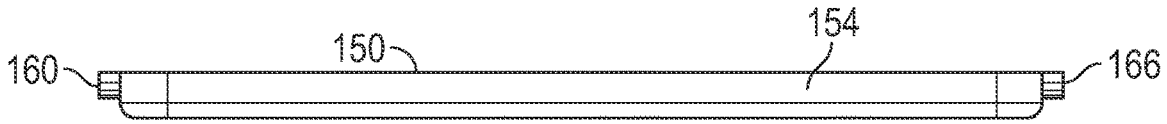
FIG. 13 is a rear elevational view of the shelf of FIG. 9.
Figure 14:
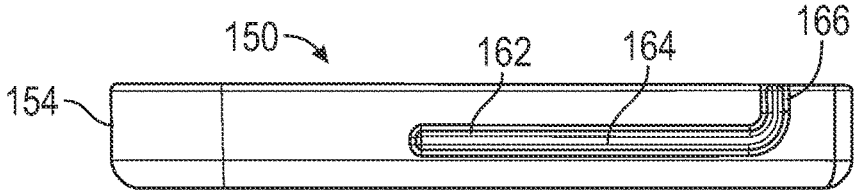
FIG. 14 is a left side elevational view of the shelf of FIG. 1, with the right side elevational view being a mirror image thereof.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Referring to FIG. 1, a shelf assembly 100 ("assembly 100") according to an exemplary embodiment of the present invention is shown. Shelf assembly 100 includes a left hand bracket 110, a right hand bracket 140, and a plurality of shelves 150, 170. Although only two shelves 150, 170 are shown, those skilled in the art will recognize that left hand bracket 110 and right hand bracket 140 can be modified to accommodate more than two shelves 150 170.

Referring to FIGS. 2-8, left hand bracket 110 and right hand bracket 140 are mirror images of each other and each of the left hand bracket 110 and the right hand bracket 140 comprises the same elements, so only left hand bracket 110 will be described, and such description will be applicable to right hand bracket 140 as well. Each of the left hand bracket 110 and the right hand bracket 140 has a central axis 111, such that, when each of the left hand bracket 110 and the right hand bracket 140 is rotated about its respective central axis 111, the left hand bracket 110 can be used as the right hand bracket 140 and the right hand bracket 140 can be used as the left hand bracket 110.

Bracket 110 includes an elongated wall portion 112 having a flat face 114 for applying left hand bracket 110 against a wall (not shown). A pair of spaced recesses 116 are provided in face 114 to allow for the application of an adhesive strip (not shown) to adhere bracket 110 to the wall with an adhesive. Instead of or in addition to an adhesive, through openings 118 are provided in wall portion 112 to allow for the insertion therethrough of screws (not shown) to screw bracket 110 into the wall. Notches 119 are provided at the top and bottom of wall portion 112 along a longitudinal centerline of wall portion 112. Notches 119 are provided to align wall portion 112 with wall studs (not shown) that are typically located 16 inches off-center in the frame of the wall.

A shelf support portion 120 extends orthogonally from the wall portion 112 and includes a horizontal support bracket 121 to add stability to shelf support portion 120. Open spaces 123, 133 on either side of horizontal support bracket 121 reduce weight and material of shelf support portion 120.

Shelf support portion 120 also includes an upper shelf support assembly 122 comprising an upper shelf support 124 extending orthogonally from the shelf support portion 120, a first upper prong 126 extending outwardly from the shelf support portion 120 above the upper shelf support 124, and a second upper prong 128 extending outwardly from the shelf support portion 120 below the upper shelf support 124. Similarly, a lower shelf support assembly 132 comprises a lower shelf support 134 extending orthogonally from the shelf support portion 120, a first lower prong 136 extending outwardly from the shelf support portion 120 above the lower shelf support 132, and a second lower prong 138 extending outwardly from the shelf support portion 120 below the lower shelf support 132.

Second upper prong 128 and second lower prong 138 are provided so that, when left hand bracket 110 is flipped to become right hand bracket 140 or right hand bracket 140 is flipped to become left hand bracket 110, prongs 128, 138 are above shelf supports 124, 134. A gap 129, 139 is provided between each of the upper and lower shelf supports 122, 132, respectively, and the wall portion 112.

Referring to FIG. 1, an upper shelf 150 is configured to releasably attach to upper shelf support 122 and a lower shelf 170 is configured to releasably attach to lower shelf support 132. Each of upper shelf 150 and lower shelf 170 are similar, so identical elements of each of shelves 150, 170 will be described with reference to upper shelf 150 in FIGS. 9-14. Upper shelf 150 includes a planar surface 152 bounded by a lip 154. Upper shelf 150 further has a left upper shelf tab 156 extending from lip 154 and a right upper shelf tab 162 extending from the lip 154, distal from the left upper shelf tab 156.

Each of the left and right shelf tabs 156, 162 comprises a shelf resting portion 158, 164 and an arcuate portion 160, 166, respectively, extending from the shelf resting portion 158, 164. The shelf resting portions 158, 162 each comprises a flat portion configured to engage the upper shelf support 122 on each of left and right hand brackets 110, 140, respectively, such that left and right hand brackets 110 140 support shelf 150. The arcuate portions 160, 166 are configured to at least partially wrap around the first upper prong 126 on wall support 120.

Figure 15:
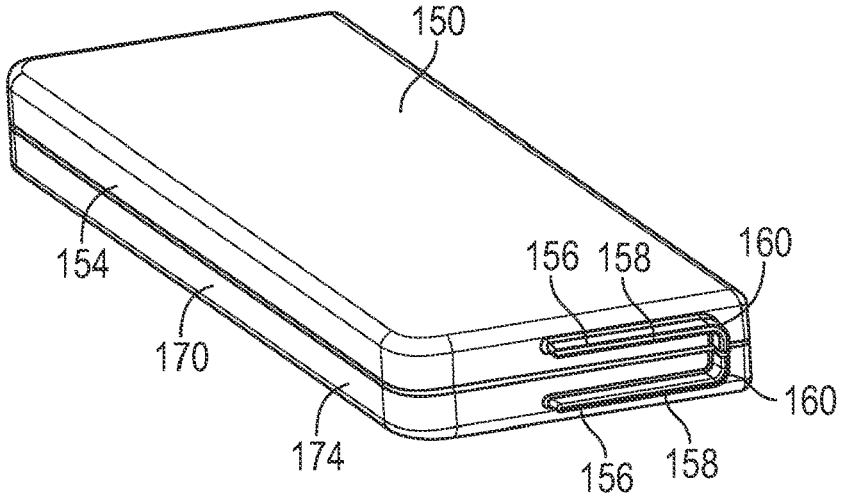
FIG. 15 is a perspective view of the upper and lower shelves from the assembly of FIG. 1 stacked on top of each other.
Figure 16:
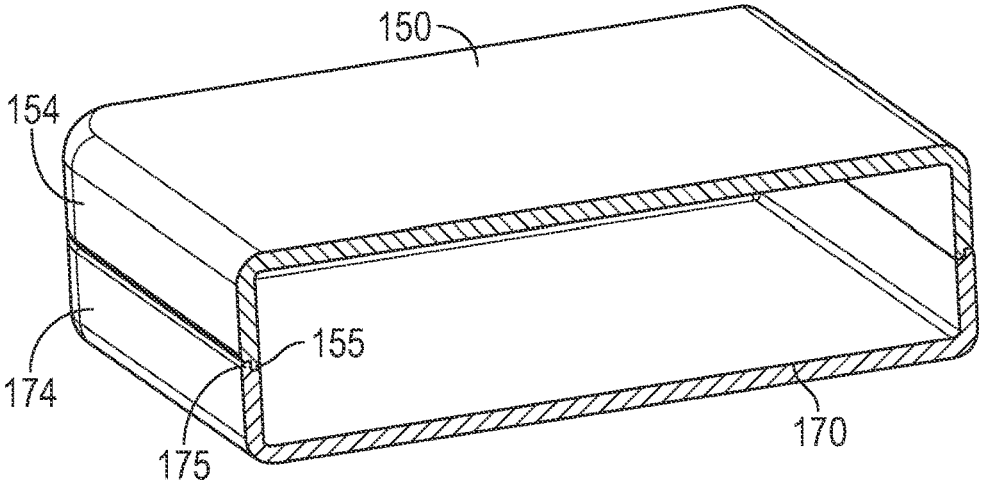
FIG. 16 is a sectional view of the stacked shelves of FIG. 15.
Figure 17:
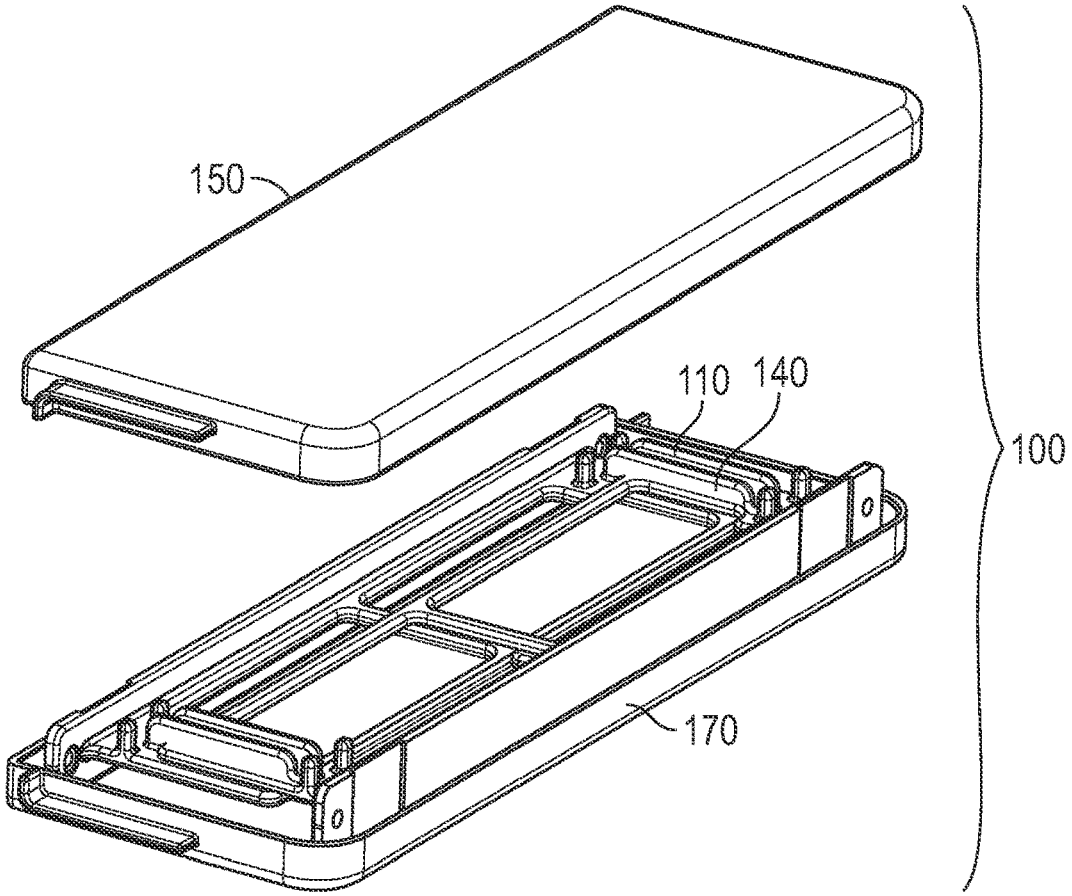
FIG. 17 is an exploded view of wall brackets from the assembly of FIG. 1 inserted between the stacked shelves for packaging.
Figure 18:
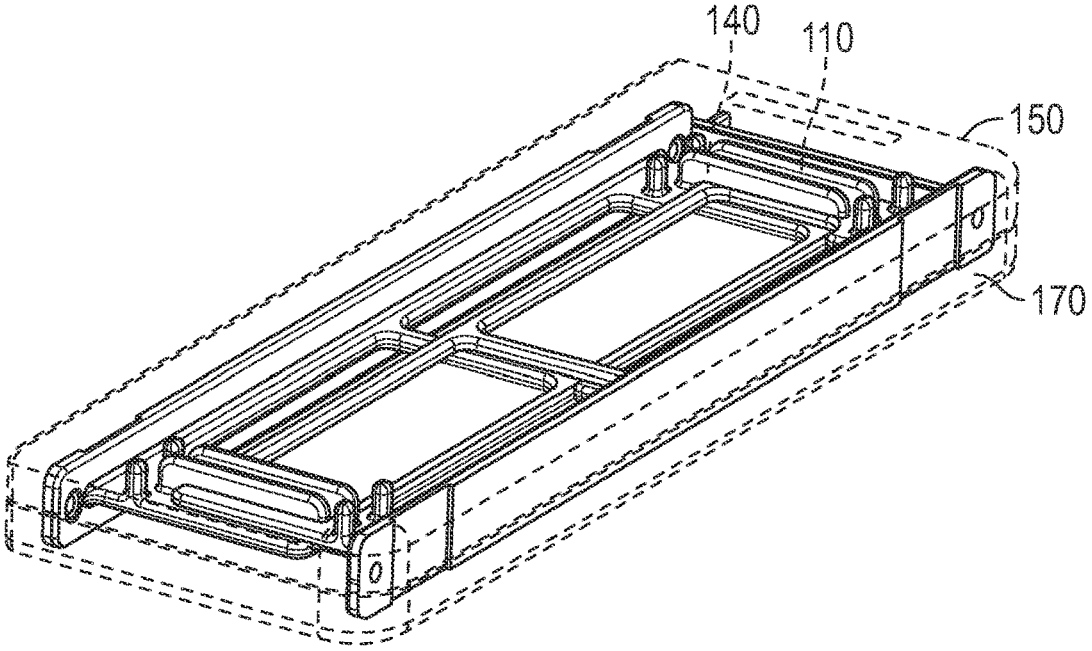
FIG. 18 is a perspective view of the wall brackets from the assembly of FIG. 1 inserted between the stacked shelves for packaging.

The difference between upper shelf 10 and lower shelf 170 is that upper shelf 150 comprises an external beveled lip 155 around the perimeter of lip 154 and the lower shelf 170 comprises an internal beveled lip 175 around the perimeter of lip 174 such that, when the upper shelf 150 is placed on the lower shelf 170, such as for packaging and shipping, the external beveled lip 154 engages the internal beveled lip 174 such that the upper shelf 150 and the lower shelf 170 are rigidly coupled to each other, as shown in FIGS. 15 and 16. In addition, as shown in FIGS. 17 and 18, brackets 110, 140 can be placed between the "clamshell" configuration of the upper shelf 150 and the lower shelf 170 to in reducing the size of packaging of assembly 100.

To assemble assembly 100, left hand bracket 110 and right hand bracket 140 are spaced apart a sufficient distance, typically 16 inches on center, to allow shelves 150, 170 to be slid between the brackets 110, 140 such that shelves 150, 170 are supported by brackets 110, 140, as shown in FIG. 1.

Figure 19:
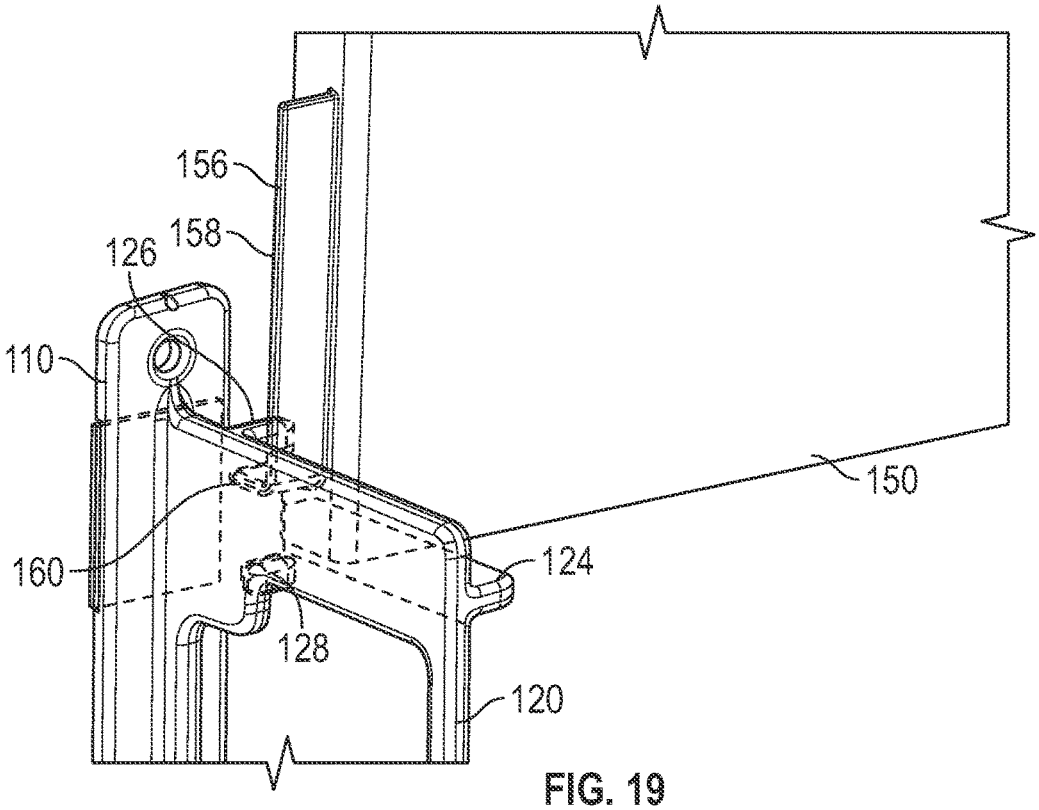
FIG. 19 is a perspective view of a shelf from FIG. 9 being inserted into a wall bracket of FIG. 2.
Figure 20:
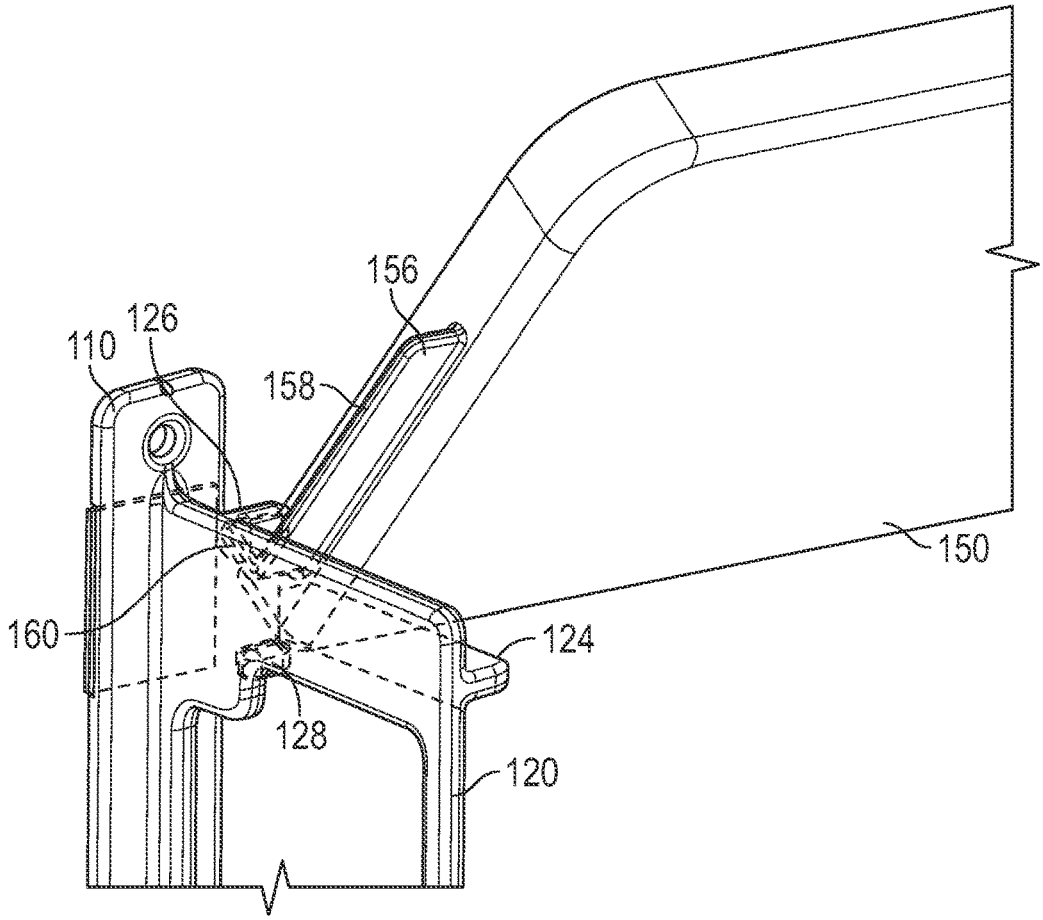
FIG. 20 is a perspective view of the shelf of FIG. 19 being tilted downwardly.
Figure 21:
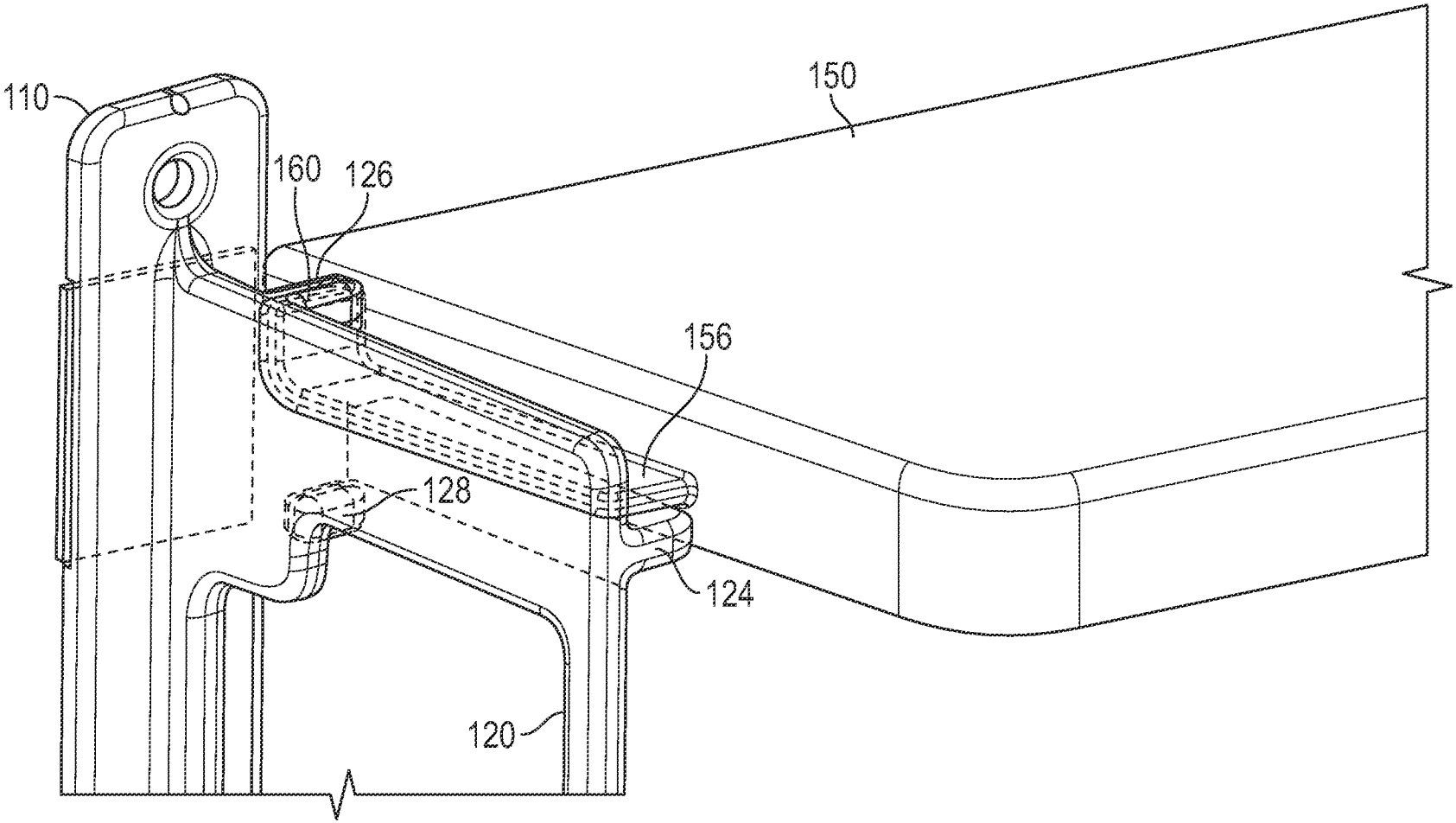
FIG. 21 is a perspective view of the shelf of FIG. 20 laid on top of the bracket of FIG. 2.

Upper shelf 150 is located between left hand bracket 110 and right hand bracket 140 at an angle as shown in FIG. 19 so that arcuate portions 160, 166 are between upper shelf support 124 and first upper prong 126 so that arcuate portion 260, 166 is slid under first upper prong 126. Upper shelf 150 is then pivoted to the position shown in FIG. 20 and then in the position shown in FIG. 21 so that shelf resting portion 158, 164 rests on upper shelf support 124. The process is repeated for lower shelf 170 and lower shelf support 134.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A shelf assembly comprising:

a left hand bracket and a right hand bracket, wherein each of the left hand bracket and the right hand bracket comprises:

an upper shelf support extending toward the other of the left hand bracket and the right hand bracket; and a lower shelf support extending toward the other of the left hand bracket and the right hand bracket;

an upper shelf having an upper shelf bottom surface, a plurality of upper shelf side walls extending upwardly from the upper shelf bottom surface, and a first upper shelf tab directly connected to one of the plurality of upper shelf side walls and a second upper shelf tab directly connected to an opposing side of the one of the plurality of upper shelf side walls, both upper shelf tabs extending outwardly from their respective upper shelf side wall, each of the upper shelf tabs being configured to rest on the upper shelf support;

and a lower shelf having a lower shelf bottom surface, a plurality of lower shelf side walls extending upwardly from the lower shelf bottom surface, and a first lower shelf tab directly connected to one of the plurality of lower shelf side walls and a second lower shelf tab directly connected to an opposing side of the one of the plurality of lower shelf side walls, both lower shelf tabs extending outwardly from their respective lower shelf side wall, each of the lower shelf tabs being configured to rest on the lower shelf support, wherein each of the left hand bracket and the right hand bracket comprises a first upper prong and a first lower prong extending outwardly therefrom, the first upper prong configured to engage the upper shelf tab and the first lower prong configured to engage the lower shelf tab, and wherein each of the upper shelf tab and the lower shelf tab comprises a fixed arcuate portion configured to engage the first upper prong and the first lower prong, respectively.

2. The shelf assembly according to claim 1, wherein each of the left hand bracket and the right hand bracket comprises a shelf support portion supporting each of the upper shelf support and the lower shelf support.

3. The shelf assembly according to claim 1, wherein the first upper prong extends above the upper shelf support and the first lower prong extends above the lower shelf support.

4. The shelf assembly according to claim 3, further comprising a second upper prong extending below the upper shelf support and a second lower prong extending below the lower shelf support.

5. The shelf assembly according to claim 1, wherein each of the upper shelf tab and the lower shelf tab comprises a flat portion configured to engage the upper shelf support and the lower shelf support, respectively.

6. The shelf assembly according to claim 1, wherein each of the left hand bracket and the right hand bracket are mirror images of each other.

7. The shelf assembly according to claim 1, wherein each of the left hand bracket and the right hand bracket has a central axis, and wherein, when each of the left hand bracket and the right hand bracket is rotated about its respective central axis, the left hand bracket can be used as the right hand bracket and the right hand bracket can be used as the left hand bracket.

8. A shelf assembly comprising:

a left hand bracket and a right hand bracket, wherein each of the left hand bracket and the right hand bracket comprises:

an upper shelf support extending toward the other of the left hand bracket and the right hand bracket; and a lower shelf support extending toward the other of the left hand bracket and the right hand bracket;

a upper shelf having an upper shelf tab configured to rest on the upper shelf support;

and a lower shelf having a lower shelf tab configured to rest on the lower shelf support, wherein the upper shelf comprises an external beveled lip and the lower shelf comprises an internal beveled lip such that, when the upper shelf is placed on the lower shelf in an inverted position with the upper shelf being level on the lower shelf, the external beveled lip engages the internal beveled lip such that the upper shelf and the lower shelf are rigidly coupled to each other.

9. A shelf assembly comprising:

a left hand bracket and a right hand bracket, wherein each of the left hand bracket and the right hand bracket comprises:

an upper shelf support extending toward the other of the left hand bracket and the right hand bracket; and a lower shelf support extending toward the other of the left hand bracket and the right hand bracket;

an upper shelf having an upper shelf tab configured to rest on the upper shelf support;

and a lower shelf having a lower shelf tab configured to rest on the lower shelf support, wherein each of the left hand bracket and the right hand bracket comprises a first upper prong and a first lower prong extending outwardly therefrom, the first upper prong configured to engage the upper shelf tab and the first lower prong configured to engage the lower shelf tab, wherein each of the upper shelf tab and the lower shelf tab comprises a fixed arcuate portion configured to engage the first upper prong and the first lower prong, respectively, such that, to install each of the upper shelf and the lower shelf between the left hand bracket and the right hand bracket, the arcuate portion is slid under the first upper prong and the shelf is then pivoted to a horizontal position so that the shelf rests on the respective shelf support.

* * * * *